US007883363B2

(12) United States Patent
Montena

(10) Patent No.: US 7,883,363 B2
(45) Date of Patent: Feb. 8, 2011

(54) PHASE ADJUSTABLE ADAPTER

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 57 days.

(21) Appl. No.: 12/479,090

(22) Filed: Jun. 5, 2009

(65) Prior Publication Data

US 2010/0311277 A1 Dec. 9, 2010

(51) Int. Cl.
*H01R 9/05* (2006.01)

(52) U.S. Cl. ..... 439/578; 439/654

(58) Field of Classification Search ..... 439/578, 439/638, 654

See application file for complete search history.

(56) References Cited

U.S. PATENT DOCUMENTS 4,527,163 A * 7/1985 Stanton ..... 343/700 MS
4,585,289 A 4/1986 Bocher
4,741,702 A 5/1988 Yasumoto
4,772,223 A 9/1988 Yasumoto
4,779,067 A 10/1988 Johanson
4,824,399 A 4/1989 Bogar et al.
5,746,623 A 5/1998 Fuchs et al.
6,575,785 B2 6/2003 Bohmer et al.
6,722,025 B2 4/2004 Bohmer et al.

* cited by examiner

*Primary Examiner*—Tho D Ta
(74) *Attorney, Agent, or Firm*—Marjama Muldoon Blasiak & Sullivan LLP

(57) ABSTRACT

A phase adjustable adapter that can maintain its value of characteristic impedance in a manner that is independent of its electrical length. Embodiments of the adapter include a center conductor and an adapter body in surrounding relation to the center conductor so as to form an insulative gap. The adapter body has form factor that is defined by the ratio of an outer dimension of the adapter body to the length of the adapter body, where the form factor changes in accordance with the change in the length of the adapter body.

20 Claims, 3 Drawing Sheets

PHASE ADJUSTABLE ADAPTER

FIELD OF THE INVENTION

The present invention is directed to electrical adapters, and more specifically, to electrical adapters that have a value of characteristic impedance that is independent of the electrical length of the adapter.

BACKGROUND OF THE INVENTION

Cable/broadband, telecom, wireless, and satellite industries connect a variety of electrical components, e.g., antennas, amplifiers, diplexers, surge arrestors, with transmission lines, and adapters, to form systems that transmit alternating current electrical signals that can be arranged in an analog and/or digital format. One measure of the success of these systems is the efficiency with which the electrical signals are transmitted amongst these components. Engineers, designers, and technicians in these industries, however, are aware that the level of transmission efficiency that is attained is dependent, in part, on the physical properties of the components that are used in their construction.

Characteristic impedance is one of these properties. More particularly, differences in the characteristic impedance of the components that are connected together can cause problems that affect the transmission efficiency. For example, in a system that includes an antenna, an amplifier, and a transmission line, the differences in the characteristic impedance of the antenna, the amplifier, and the transmission line can cause a portion of the electrical signal transmitted from the amplifier to the antenna to reflect back to the amplifier. This, in turn, can cause standing wave patterns to form in the transmission line when the electrical signal transmitted from the amplifier to the antenna reacts with the electrical signal reflected from the antenna to the amplifier.

Impedance matching is one way to alleviate some of these problems. The goal is to create a system that has a substantially uniform characteristic impedance, which for many systems of the type disclosed and contemplated herein is nominally about 50 ohm, 75 ohm or 90 ohm. Characteristic impedance values that are exhibited by each of the transmission lines and the adapters are determined by a variety of factors, such as, for example, the geometry of the transmission line, the geometry of the adapter structure, and the corresponding dielectric material between the conductors. Similarly, it is generally recognized by those artisans having ordinary skill in the electrical arts that, in one example, the value of characteristic impedance for the adapter can be calculated according to the Equation 1 below, $$Z=\sqrt{Z_1 \times Z_2}, \qquad \text{Equation (1)}$$

where Z is the characteristic impedance of the adapter, and $Z_1$ and $Z_2$ are the values of characteristic impedance for various components in the system. Accordingly, creating a system having substantially uniform characteristic impedance includes matching the characteristic impedance values of the transmission lines, e.g., coaxial cable, and the adapters that electrically couple the conductors of the transmission lines with other transmission lines, and with the electrical components.

The phase of the electrical signal is another property, that can impact the transmission efficiency. More particularly, it may be necessary to shift the phase of the signal to avoid reflection of the signal in the adapter. Phase matching is therefore another way to improve the efficiency of signal transmission. This was traditionally accomplished by providing transmission lines of excess length that are assembled with a free end and a connector (or adapter) attached to the end opposite the free end of the transmission line. The excess length is purposefully left so that the transmission line can be cut to a pre-determined length on the basis of the measurement of the phase, e.g., by measuring the return loss in the system. This is a very lengthy and inefficient procedure.

To improve the phase matching process, another way to match the phase is to adjust the electrical length of the adapter, or the length of the adapter as it appears to the electrical signal. The electrical length is considered to be the length of the adapter measured in wavelengths (λ). It will be generally recognized by those artisans having ordinary skill in the electrical arts that, in one example, the electrical length can be calculated according to Equation 2 below, $$l_{electrical} = \frac{l_f}{984V_f}, \qquad \text{Equation (2)}$$

where $l_{electrical}$ is the electrical length, $l_f$ is the length of the adapter, and $V_f$ is the velocity factor of the adapter, e.g., the ratio of the wave velocity to the speed of light, and the numerical value 984 is provided so that the unit of measure of the electrical length ($l_{electrical}$) is provided in feet.

Changes to the electrical length of the adapter, however, can often change its value of characteristic impedance. This is not particularly preferred, of course, because it can intensify the impedance mismatch in the system, counteract the benefits that the change to the electrical length, and effectively reduce the efficiency with which the electrical signals are transmitted through the system. Adapter technology that addresses this trade off between changes in the electrical length and the need to keep constant the value of characteristic impedance has been described variously in, for example, U.S. Pat. Nos. 4,741,702 and 4,772,223 to Yasumoto, which disclose connectors where the characteristic impedance is held constant when electrical path length is adjusted, for example, by rotating portions of the connector (U.S. Pat. No. 4,741,702), or by using an adjustment element and corresponding impedance matching screws (U.S. Pat. No. 4,741,702). U.S. Pat. No. 4,724,399 to Bogar et al discloses a phase shifter where the electrical length is changed by increasing and decreasing the axial length of two opposing dielectric means. And, U.S. Pat. No. 5,746,623 to Fuchs et al. shows an integrated trimmer where the value of characteristic impedance is held constant despite changes in the electrical length. This device includes a clamping sleeve that surrounds a pair of housing parts and interior conductor parts. By turning the clamping sleeve, the housing parts translate inside of the clamping sleeve in manner that changes the electrical length of the trimmer. This arrangement, however, has several disadvantages because the housing parts translate inside of the clamping sleeve, and the conductor parts and the housings are so dimensioned so as to cause reflection points between the outer diameter of the conductor parts and the inner diameter of the housing parts.

None of the connectors discussed above, however, are configured where the physical length of the connector and the electrical length connector change, while the value of characteristic impedance remains unchanged. To some extent this may limit the applicability of the aforementioned devices, or make some particularly ill-suited to provide enough adjustment to the electrical length as is necessary to match the phase of electrical signals. For example, the proper adjustment may require that the electrical length is equal to about the wavelength (λ) of the electrical signal.

Thus, although mismatches in the characteristic impedance of the transmission lines and the adapters, as well as deviations in the phase of the electrical signal, can degrade the quality of the electronic signal, these mismatches are essentially inevitable. In fact, constraints on cost, manufacturing tolerances, and material selection, among other limitations, cause many adapters that are presently available to exacerbate the problem. Despite these issues, efforts that are directed to provide phase adjustment in combination constant characteristic impedance to balance the value of characteristic impedance of the components, transmission lines, and in particular the adapters, throughout the system have thus far been unsatisfactory, or have resulted in rigid solutions with limited application in systems utilizing higher frequency regimes.

Therefore, an adapter is needed that can facilitate phase matching without changing the nominal value of characteristic impedance of high frequency systems. It is likewise desirable that, in addition to being configured to support a range of electrical lengths, the adapter should be robust enough so that it can be implemented in a variety of systems and applications.

SUMMARY OF THE INVENTION

The present invention will substantially improve the efficiency that electrical signals are transmitted amongst the components in a system. As discussed in more detail below, adapters that are made in accordance with the present invention have a value of characteristic impedance that is independent of the physical and electrical length of the adapter so that the electrical length can be adjusted to match the phase of the electrical signal, without substantially affecting the nominal value of impedance of the system.

In accordance with one embodiment, an adapter for conducting an electrical signal having a wavelength (λ), the adapter comprising a center conductor having a longitudinal axis, an adapter body in surrounding relation to the center conductor, the adapter body having an outer dimension and a length including a first length and a second length that is greater than the first length, and an insulative gap disposed between the center conductor and the adapter body, the insulative gap remaining substantially constant along the length, wherein the adapter body has a form factor defined as the ratio of the outer dimension to the length, the form factor includes a first form factor at the first length and a second form factor at the second length, the second form factor is less than the first form factor.

In accordance with another embodiment, a phase adjustable adapter for use in a system having a nominal value of characteristic impedance, the phase adjustable adapter comprising a center conductor having a longitudinal axis, a first elongated section in surrounding relation to the center conductor, a second elongated section insertably engaging the first elongated section along the longitudinal axis, the second elongated section having a first position and a second position that is different than the first position, and an insulative gap disposed between the center conductor and the adapter body, the insulative gap remaining substantially constant when the second elongated section moves from the first position toward the second position, wherein the first elongated section and the second elongated section form an adapter body that has a form factor has a first form factor at the first position and a second form factor at the second position, the second form factor is less than the first form factor when the form factor is defined in accordance with, $$f_f = \frac{D}{l},$$

where $f_f$ is the form factor, D is an outer dimension of the adapter body, and l is a length of the adapter body In accordance with yet another embodiment, a method of varying an electrical length of an adapter for connecting a first component and a second component in a system having a nominal value of characteristic impedance, the method comprising providing a center conductor having a longitudinal axis, providing an adapter body in surrounding relation to the center conductor, the adapter body including a first elongated section and a second elongated section insertably engaging the first elongated section, the second elongated section having a first position and a second position that is different than the first position, and forming an insulative gap between the center conductor and the adapter body, the insulative gap remaining substantially constant when the second elongated section moves from the first position toward the second position, wherein the first elongated section and the second elongated section form an adapter body that has a form factor has a first form factor at the first position and a second form factor at the second position, the second form factor is less than the first form factor when the form factor is defined in accordance with, $$f_f = \frac{D}{l},$$

where $f_f$ is the form factor, D is an outer dimension of the adapter body, and l is a length of the adapter body.

BRIEF DESCRIPTION OF THE DRAWINGS

For a further understanding of the nature and objects of the invention, references should be made to the following detailed description of a preferred mode of practicing the invention, read in connection with the accompanying drawings in which.

DETAILED DESCRIPTION OF THE INVENTION

Figure 1:
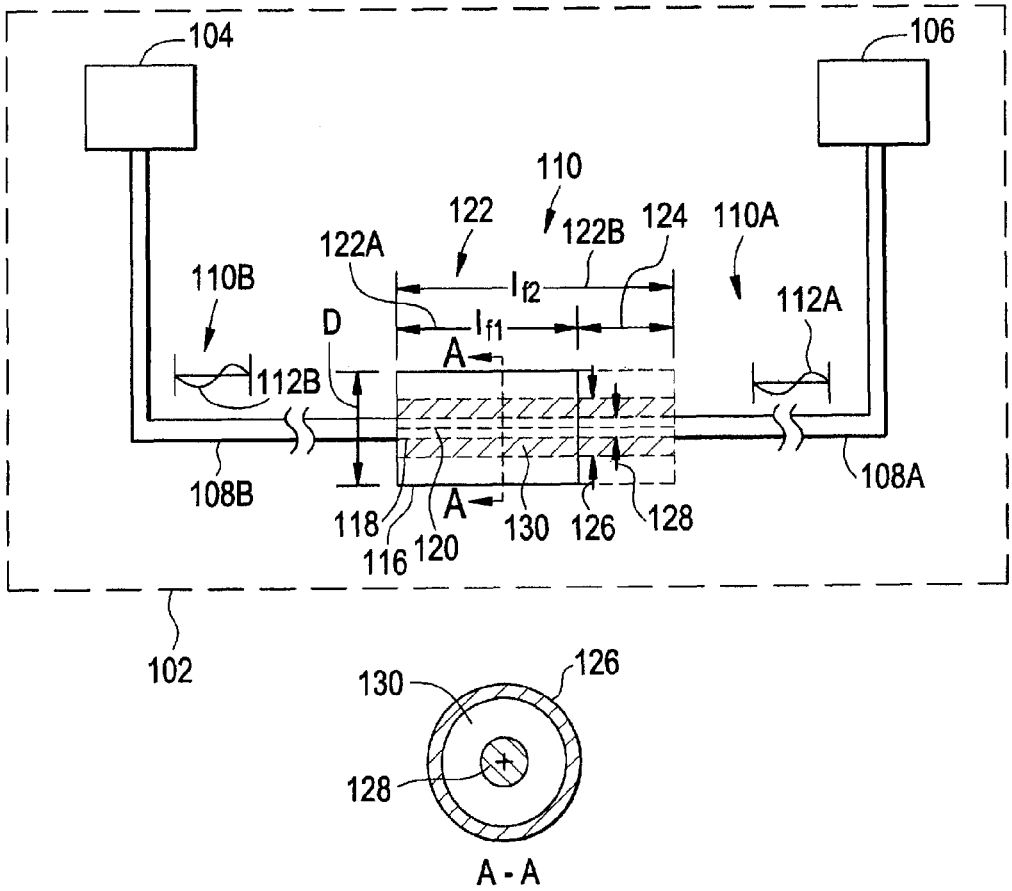
FIG. 1 is a schematic of a system that includes an example of a phase adjustable adapter.

Referring now to the figures, FIG. 1 illustrates an example of a phase adjustable adapter 100 that is made in accordance with concepts of the present invention. In the present example, the adapter 100 is implemented in a system 102 that includes a first component 104 and a second component 106 that is connected to the first component 104 via transmission lines 108. Exemplary components that are found in systems like system 102 include, but are not limited to, antennas, diplexers, surge arrestors, and amplifiers, as well as other components, like, tuners, radios, oscilloscopes, and any combinations thereof. These are often connected with a first transmission line 108A and a second transmission line 108B that is connected to the adapter 100 opposite the first transmission line 108. Each of the transmission lines 108A-B carry an electrical signal 110 and, more particularly, a first electrical signal 110A and a second electrical signal 110B that have certain signal properties, such as, for example, wavelength 112, where the first electrical signal 110A has a first wavelength 112A and the second electrical signal 110B has a second wavelength 112B.

Transmission lines of the type used as the transmission lines 108A-B are typically signal-carrying conductors such as, for example, coaxial cable, shielded cable, optical fiber cable, multi-core cable, ribbon cable, and twisted-pair cable, among others. Selection of the type of transmission line can vary based on the system in which it is implemented, and so it is expected that the adapter 100 will have relative dimensions that are consistent with, and complimentary to, the particular type of transmission line that is selected for transmission line 108. Moreover, many of the components and corresponding transmission lines, as well as other components that are not listed or discussed herein but that are contemplated by the concepts of the present disclosure, are found in high frequency systems, such as, for example, antenna systems for wireless devices, satellite links, microwave data links, radio astronomy devices, cell tower installations, and the like.

It was discussed in the Background section above that systems in which adapters of the type used as adapter 100 are implemented exhibit a nominal value of characteristic impedance that is influenced by the value of characteristic impedance of each of the individual components. This includes the adapters, and more particularly, adapters like the adapter 100 that are used to conduct the electrical signals 110A-B between the transmission lines 108A-B. It was also discussed in the Background section that it is likewise important that such adapters prevent the electrical signals 110A-B from reflecting back towards the transmission lines 108A-B. To avoid this reflection of electrical signals, it is sometimes necessary that the connections between the transmission lines 108 and the adapter 100 are made so as to cause the connection to occur at certain points along the wavelength 112 of the electrical signal 110. The tradeoff, however, is that embodiments of adapter 100 are constructed so as to maintain as constant the value of characteristic impedance.

As discussed in more detail below, adapters like the adapter 100 of FIG. 1 are configured to have a value of characteristic impedance that is substantially independent of the configuration of the adapter 100. This is beneficial because adapters that are used as adapter 100 in the system 102 can be adjusted to match the phase of the electrical signal 110. For example, in certain implementations of the adapter 100, the adapter 100 is configured so that the point along the wavelength 112 where the transmission line 108A is connected to the adapter body 116 changes in a manner that substantially reduces the likelihood of reflection of the electrical signal 110 in the adapter 100. This is preferably accomplished in a manner that does not change the value of characteristic impedance of the adapter 100.

In view of the foregoing, embodiments of the phase adjustable adapter 100 include an adapter body 116 and a center conductor 118 that has a longitudinal axis 120 that is effectively surrounded by the adapter body 116. The center conductor 118 is configured so that it has a length 122 that includes a first length 122A and a second length 122B that is different from the first length 122A by a variable dimension 124. In one example, the variable dimension 124 is selected so that the second length 122A extends to a distance that is consistent with about the full wavelength, e.g., wavelength 112, of the electrical signal 110. In another example, the variable dimension 124 is about 3 inches. In still another example, the variable dimension 124 is from about 2 inches to about 5 inches. Preferably, but not necessarily, the second length 122A is consistent with less than about the full wavelength 112 of the electrical signal 110, such as, for example, where the second length 122A is about one quarter of the wavelength 112.

In the present example of the adapter 100, the adapter body 116 has an outer dimension D that defines the extent to which the outer portions of the adapter body 116 are positioned in relation to the longitudinal axis 120. By way of non-limiting example, when the adapter body 116 is substantially cylindrical as it is illustrated in the exemplary adapter of FIG. 1, the outer dimension D defines the diameter of the corresponding cylinder that encompasses the outer most portion of the adapter body 116. Likewise, and also by non-limiting example, if the adapter body 116 is substantially rectangular, cubical, or has an otherwise three-dimensional shape, the outer dimension D defines the dimension of the corresponding shape that encompasses the outer most portion of the adapter body 116.

The outer dimension D can be related to the length of the adapter body 100, e.g., the second length 122A, by way of a form factor ($f_f$). For clarity and ease of discussion herein, this form factor ($f_f$) can be expressed in the form of Equation 3 below, $$f_f = \frac{D}{l_{f2}}, \qquad \text{Equation (3)}$$

where $f_f$ is the form factor, D is the outer dimension of the adapter body, and $l_{f2}$ is a length of the adapter body, e.g., the second length 122A. It may be desirable that the form factor ($f_f$) have a value that is less that about 1, with the form factor ($f_f$) in certain embodiments of the adapter 100 having a value that is less than about 0.75.

The adapter 100 is generally elongated in shape, with a preferred construction of the adapter body 116 including one or more elongated cylindrical sections that interleave, or overlap, to form a substantially rigid outer shell. These sections may move relative to one another so that the relative movement changes the length 122, such as, for example, by changing the variable dimension 124. The center conductor 118 conducts the electrical signals 110 across the adapter 100, such as, for example, between the transmission lines 108. Depending on the particular application, the center conductor 118 is metallic, e.g., copper, aluminum, gold, etc., and may have a number of conductive sections that are solid or hollow. Each of the conductive sections are generally electrically coupled to one or more of the other conductive sections, with one preferred construction of the center conductor 118 of the adapter 100 that has sections mechanically coupled to the adapter body 116 so that, for example, the relative movement of the elongated cylindrical sections causes relative movement of the conductive sections without the loss of electrical signal conduction.

Figure 2:
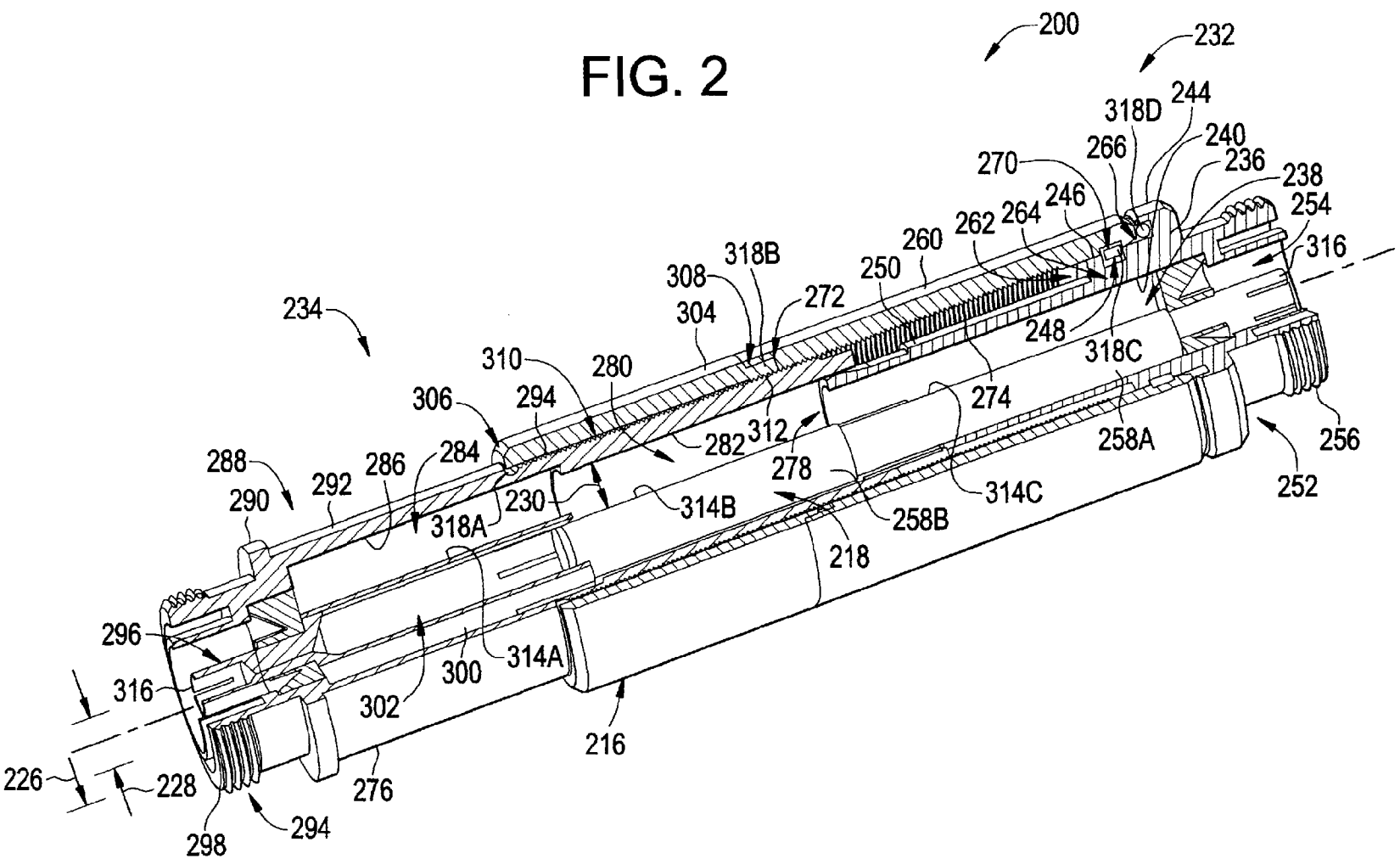
FIG. 2 is a perspective view of a partial cross-section of another example of a phase adjustable adapter.

As discussed in more detail in connection with FIG. 1 and also section A-A of the phase adjustable adapter 100 of FIG. 1, the adapter body 116 and the center conductor 118 may include, respectively, an inner shape 126, and an outer shape 128 that is smaller than the inner shape 126 so that the difference between the inner shape 126 and the outer shape 128 forms an insulative gap 130. The inner shape 126 generally defines the form of the inner portion of the adapter body 116, while the outer shape 128 generally defines the form of the outer portion of center conductor 118. By way of non-limiting example, the inner shape 126 and the outer shape 128 that are illustrated in FIG. 1 and section A-A are generally cylindrical with a circular cross-sections. It is contemplated, however, that the inner shape 126 and the outer shape 128 can have any variety and combination of forms that have, for example, circular cross-sections, square cross-sections, rectangular cross-sections, and elliptical cross-sections, among others. The inner shape 126 and the outer shape 128 may likewise be tapered, varied, or otherwise non-uniform as measured from either end of the adapter body 116, from opposite sides of the adapter body 116, or generally at different points along and around the longitudinal axis 120 of the adapter 100. In one example, the outer shape 126 of the center conductor 118 may have a plurality of circular cross-sections that each have a different outer diameter that extends along a portion of the adapter 100. An example of this is illustrated in the exemplary adapter that is illustrated in FIG. 2, which is suited for use as adapter 100 in system 102.

As it is illustrated in FIG. 1, the insulative gap 130 is substantially constant across the adapter body 116, in a preferred construction of the adapter body 116 and the center conductor 118, the insulative gap 130 remains substantially constant when the variable dimension 124 changes, and in an even more preferred construction, the insulative gap 130 is substantially the same at the first length 122A and at the second length 122B. The insulative gap 130 may be filled with one or more dielectric materials, such as, but are not limited to, polycarbonate, polyethlylene, TEFLON®, ULTEM®, and any combinations thereof. Air is also a suitable material. For example, air can be used if the insulative gap 130 does not include any other dielectric material, if the insulative gap 130 is only partially filed with dielectric material, or if air is incorporated into, or otherwise introduced to the insulative gap 130 as part of the selected dielectric material for use in the adapter 100.

The adapter body 116 is also configured to engage the component, e.g., the transmission lines 108A-B, so that the electrical signal 110 is conducted between the transmission line 108A and the transmission line 108B. Exemplary adapters for use as the phase adjustable adapter 100 typically include connective elements for coupling the adapter body 116 to these components, such as, for example, screw-threaded fittings, snap fittings, pressure release fittings, deformable fittings, and any combinations thereof. In one example, the connective elements on the adapter body 116 are adapted to mate with threaded receptacles on the transmission lines 108A-B. In another example, the connective element is selected from the group of connector interfaces consisting of a BNC connector, a TNC connector, an F-type connector, an RCA-type connector, a 7/16 DIN male connector, a 7/16 female connector, an N male connector, an N female connector, an SMA male connector, and an SMA female connector.

A detailed discussion of one embodiment of an adapter that is suitable for use as the phase adjustable adapter 100 is provided in connection with FIGS. 2-3 below. Before continuing with that discussion, however, a brief description of the implementation of the adapter 100 as it relates to systems, like the system 102 illustrated in FIG. 1, is discussed immediately below. By way of non-limiting example, in one implementation, a user, e.g., a technician installs the phase adjustable adapter 100 in-line with the transmission lines that connect a pair of components. The technician can couple the adapter to each of the transmission lines using, for example, hand tools that are consistent with the connective element of the adapter body. The technician can then adjust the length of the adapter so that the length of the adapter matches the phase of the electrical signal, without changing the value of characteristic impedance of the adapter.

Referring next to FIG. 2, FIG. 2 illustrates another example of a phase adjustable adapter 200 that is made in accordance with concepts of the present invention. Here, it is seen that some of the portions of the system, e.g., system 102 (FIG. 1), have been removed for clarity, but that numerals are used to identify like components, such as those components in FIG. 1 above, but that the numerals are increased by 100. For example, the adapter 200 of FIG. 2 includes an adapter body 216 with an inner shape 226, a center conductor 218 with an outer shape 228, a longitudinal axis 220, and an insulative gap 230 that is formed between the inner shape 226 and the outer shape 228.

The adapter 200 further includes a fixed side 232 and a telescoping side 234 that is opposite of the fixed side 232 of the adapter 200. It is understood that the terms "fixed side" and "telescoping side" are used herein to refer to opposite ends of an element or object, e.g., adapter 200, and do not limit the scope and spirit of the present invention as disclosed and described herein. Rather, and as discussed in connection with the embodiment of adapter 100 of FIG. 1, parts of the adapter 200, and more particularly, some parts of the adapter body 210 are configured so that they can move relative to other parts of the adapter 200. This relative movement, while generally being defined as that motion between these parts, will in some embodiments include one part of the adapter 200, e.g., the telescoping side 234, that moves in relation to another part of the adapter 200, e.g., the fixed side 232.

Referring first to the fixed side 232 of the adapter 200, the adapter body 216 includes a substantially cylindrical elongated interior section 236 that has a bore 238 that forms a first inner shape 240 of the inner shape 226. By way of non-limiting example, and as illustrated in FIG. 2, the interior section 236 has a stepped exterior portion 242 that begins with an annular shoulder 244 and continues with consecutively smaller diameter portions, including an outer portion 246 with an annular recess 248, and an inner portion 250 that extends along the elongated body of the interior section 236. The interior section 236 also includes a connective end 252 that has a conductive terminal 254 and a connective element 256 that are near the fixed side 232. The interior section 236 further includes a fixed conductor 258 with a first fixed conductor 258A and a second fixed conductor 258B. The fixed conductor 258 is coupled to the interior section 236 so that it is in electrical communication with the conductive terminal 254.

Also on the fixed side 232 of the adapter 200 is a substantially cylindrical elongated outer section 260 that has a bore 262 with an open end 264 that can receive the interior section 236 therein. The open end 264 is shaped with a tapered section 266 that engages the annular shoulder 244. The bore 262 also has an annular recess 268 proximate the tapered section 270, and a thinned portion 272 that is opposite of the open end 264 where the diameter of the bore 262 increases as the bore 262 extends towards the telescoping end 234. The bore 252 also has threads 274, which in the present example extend into a portion of the bore 262 from the thinned portion 272.

Referring now to the telescoping side 234, the adapter body 216 includes a substantially cylindrical elongated telescoping section 276 that has an interior end 278 with a primary bore 280 that forms a second inner shape 282 of the inner shape 226 that can receive the interior section 236 therein. The telescoping section 276 also has a secondary bore 284 that extends from the primary bore 280 toward the telescoping side 234 of the adapter body 216, and which forms a third inner shape 286 of the inner shape 226.

By way of non-limiting example, and as is illustrated in FIG. 2, the telescoping section 274 also has a stepped exterior portion 288 that has an annular shoulder 290 and an elongated outer surface 292, where the diameter of the outer surface 292 is insertably received in the bore 262 of the outer section 260, and between the inner portion 250 of the interior section 236 and the bore 262 of the outer section 260. The outer surface 292 has threads 294, which in the present example of adapter 200 extend along a portion of the outer surface 292 from the interior end 278. Also on the telescoping side 234, the telescoping section 276 also includes a connective end 294 that is opposite of the interior end 278, which has a conductive terminal 296 and a connective element 298 that are near the telescoping side 234. The telescoping section 276 further includes a telescoping conductor 300 with a conductive aperture 302 that receives the fixed conductor 258, e.g., the second fixed conductor 258B, which is coupled to the interior section 236 so that it is in electrical communication with the telescoping conductor 300.

With continued reference to the telescoping side 234 of the adapter 200, the adapter body 216 also includes an external collar 304 that has a tapered side 306 and a thinned side 308 that is opposite the tapered side 306, and where the outer diameter of the external collar 304 is reduced in the direction of the fixed end 232, and more particularly, in a manner that permits the thinned side 308 to engage at least a portion of the thinned portion 272 of the outer section 260. The external collar 304 also has a bore 310 that receives the outer surface 292 of the telescoping section 274. The bore 310 has a portion with threads 312 that engage, for example, the threads 294 of the telescoping section 274.

For purposes of example only, it is seen in the example of the adapter 200 of FIG. 2 that the telescoping conductor 300 and the first and second fixed conductor 258A-B each have an outer shape 228 that includes, respectively, a first outer shape 312A, a second outer shape 312B, and a third outer shape 312C. It is likewise seen that the first inner shape 240, the second inner shape 282, and the third inner shape 286 in combination with the first outer shape 314A, the second outer shape 314B, and the third outer shape 314C form the insulative gap 230 along the adapter body 216. Preferably, but not necessarily, the length of each of the first, second and third inner shapes correspond to the length of the first, second, and third outer shapes so that the insulative gap 230 remains substantially constant, even during relative movement of the interior section 236 and the telescoping section 276. It is to be understood, however, that the term "substantially constant" as used and described herein takes into consideration certain manufacturing tolerances, assembly tolerances, and other deviations that can be injected into the overall assembly of the adapter 200. These may, for example, cause one or more of the first, second, and third inner shapes, and/or the first, second, and third outer shapes to be so dimensioned that the insulative gap 230 is not perfectly constant across the adapter body 216.

The term "substantially constant" may also be considered in the relative when used as the description of the insulative gap to be so dimensioned within certain tolerances, or, in the alternative, as the description of the insulative gap that causes the value of characteristic impedance of the adapter 200 to remain within certain tolerances. For example, regarding the former description it is contemplated that the dimensions of the insulative gap will be within a desired tolerance, e.g., about ±0.005 in. On the other hand, regarding the latter description it is contemplated that the value of characteristic impedance for adapters made in accordance with the concepts disclosed herein will be consistent with a desired value, e.g., the nominal impedance of the system when relative movement changes the variable dimension.

Optionally, adapter 200 may include a number of retentive elements 318 including retentive elements 318A-D that are disposed in annular relation to one or more of the sections of the adapter body 216. Exemplary retentive elements may include, for example, o-rings, and snap-rings, among others. These elements are typically selected to facilitate assembly of the adapter body 216, and also for certain conductive properties that can assure electrical communication between one or more of the sections of the adapter body 216. In one example, the retentive elements can also prevent rotation of one or more portions of the adapter body 216 (e.g., the telescoping section 276) when the first length changes to the second length.

It is also seen in the example of the adapter 200 of FIG. 2 that the conductive terminals 256, 298 form a plurality of flexible fingers or tines 316, the dimensions (e.g., outer diameter, inner diameter, and length) of which are so dimensioned so that the fingers 316 of the conductive terminals 256, 298 flexibly expand and contract so as to electrically engage a portion of the transmission line, e.g., the conductor (not shown) of the transmission lines 108A-B (FIG. 1). Moreover, the conductive terminals 254, 296 and the connective elements 254, 296 are arranged so that, when the transmission line is coupled to the adapter 200 via the connective elements 254, 296, the conductive terminals 254, 296 can make electrical contact with the conductor of the transmission line.

Engagement of the threads discussed in connection with the adapter body 216 above facilitates relative movement between at least the interior section 236 and the telescoping section 276. By way of non-limiting example, if the interior section 236 is held in place and the telescoping section 276 is rotated, the threaded engagement will cause telescoping section 276 to translate longitudinally along the inner portion 250 of the interior section 236. Suitable threads for use as the threads in the adapter have from about 20 threads per inch to about 40 threads per inch, although other thread dimensions (e.g., size, type, pitch, and the number of threads per inch) can also be selected in accordance with the desired relative movement between the interior section 236 and the telescoping section 274. With reference to the non-limiting example mentioned immediately above, the position of the telescoping section 276 relative to the interior section 236 will change less for each revolution of the telescoping section 276 with respect to the interior section 236 with threads that have a smaller pitch, and/or more threads per inch.

Conductive materials such as, for example, metals, and conductive plastics are generally preferred for use in the center conductor 218. This includes portions of the fixed conductor 258 and the conductive aperture 302. Exemplary materials for use in the interior section 236, the outer section 260, the telescoping section 276, and the external collar 304 include, but are not limited to, metals (e.g., aluminum, steel, brass, etc.), and composites, among many others. Likewise, manufacturing processes implemented to make the components of the adapter 200 include casting, molding, extruding, machining (e.g., turning, and milling) and other techniques that are suitable for forming the various sections and components of the adapter 200, and more particularly, the adapter body 216, which are disclosed and described herein. Because these processes, and the materials that are utilized by such processes, are generally well-known to those having ordinary skill in the art, no additional details will be provided herein, unless such details are necessary to explain the embodiments and concepts of the present invention.

Figure 3:
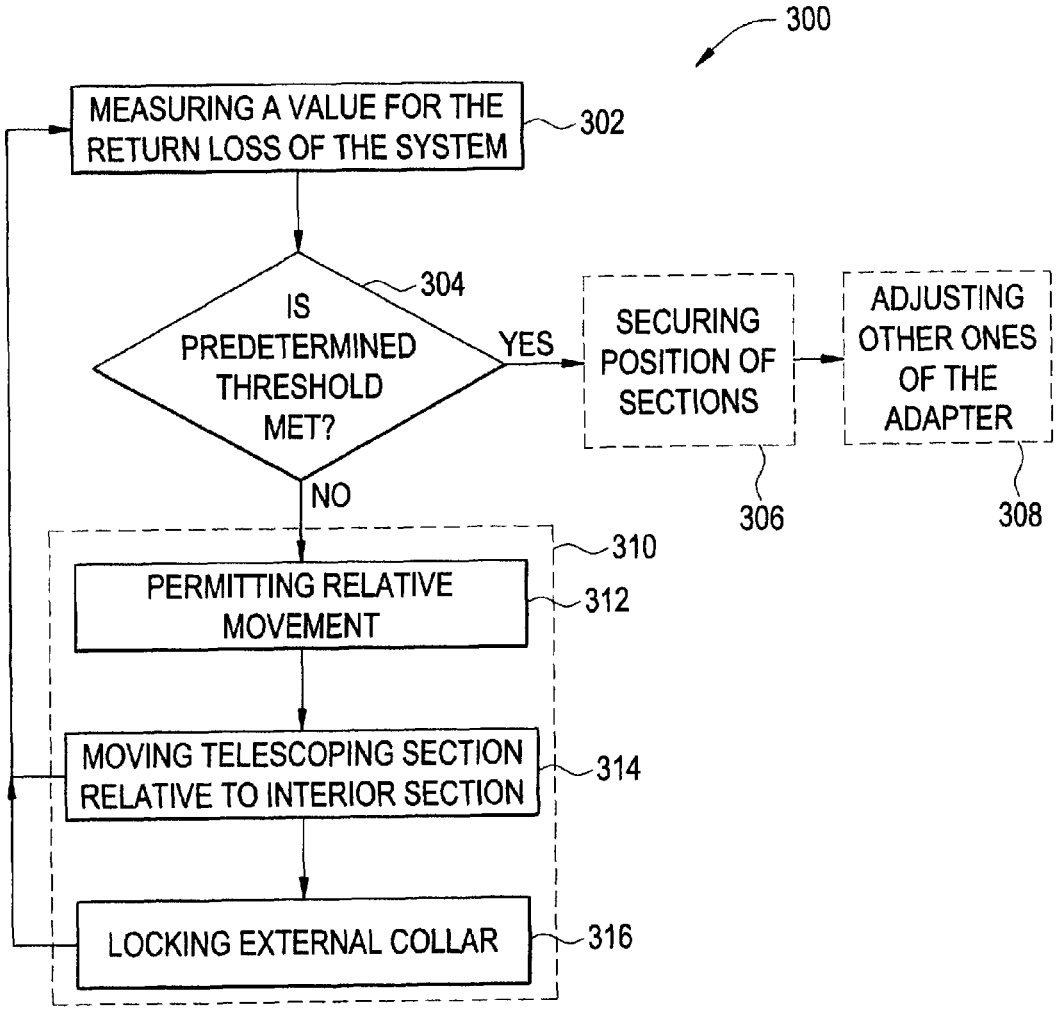
FIG. 3 is a flow diagram of a method of implementing a phase adjustable adapter, such as the phase adjustable adapters of FIGS. 1, and 2.

Discussing the operation of variable impedance adapters that are made in accordance with concepts of the present invention in more detail, FIG. 3 illustrates a method 300 for adjusting the adapter, e.g., adapter 100, 200, (collectively, "the adapter") to improve the efficiency with which a signal is transmitted between a first component 104 (FIG. 1) and a second component 106 (FIG. 2) via a pair of transmission lines that are connected to the adapter. Here, the method 300 includes, at step 302, measuring a value, e.g., a first value, of the return loss of the system that corresponds to the initial length of the adapter. In one example, the value is measured between the first component and the second component with a network analyzer, such as, for example, the Anritsu Site Master manufactured by the Anritsu Company of Morgan Hill, Calif.

Next, the method 300 includes, at step 304, determining if the first value is the value for the return loss that is desired. This may include comparing the first value to a pre-determined threshold level. Examples of the pre-determined threshold level include, but are not limited to, a desired value for the return loss, a maximum value for the return loss, and a minimum value for the return loss, among others. In one embodiment of the method 300, if the first value is equal to about the pre-determined threshold level, or alternatively, it is within a specified acceptable deviation, e.g., about ±3 decibels (dB), of about the pre-determined threshold level, then the method 300 optionally includes, at step 306, securing the position of the telescoping section, e.g., by finally locking the external collar to prevent relative movement between the interior section and the telescoping section. It is noted that, in other embodiments of the method 300, the specified acceptable deviation may vary by about ±4 decibels (dB), by an amount that is less than about 10 decibels (dB), and/or by an amount that is from about 1 decibel (dB) to about 10 decibel (dB).

The method 300 may then include, at step 308, adjusting other ones of the adapter in the system so that the length of the adapter is substantially consistent across the adapters in the system. In another embodiment of the method 300, if the first value is less than about the pre-determined threshold level, then the method 300 optionally continues to steps 306 and/or 308. In still another embodiment of the method 300, if the first value is greater than about the pre-determined threshold level, then the method optionally continues to steps 306 and/or 308.

If the first value does not meet the pre-determined threshold level in one or more of the manners described above, the method includes, at step 310, adjusting the return loss by changing the length of the adapter. This may include, at step 312, permitting relative movement between the interior section and the telescoping section of the adapter. In one example, the external collar is rotated about the telescoping section of the adapter body in a manner that permits the telescoping section to move relative to the interior section. This can be done by hand, or it may require tools, e.g., hand tools, or other devices that can apply a force sufficient to rotate the external collar.

The method 300 may also include, at step 314, moving the telescoping section relative to the elongated section. In one example, the elongated section of the adapter body is grasped, or otherwise secured, and the telescoping section is rotated. This may be done by hand, such as, for example, by using a finger or fingers to grasp the elongated section, and/or the telescoping section of the adapter body. In another example, the elongated section and/or the telescoping section is grasped, by hand or with hand-tools, and a force is applied that overcomes the frictional forces that retain the tuning elements. Optionally, the method may further include, at step 316, locking the external collar to prevent relative movement between the interior section and the telescoping section.

The method 300 then returns to step 302, measuring a value of the return loss of the system, and another value, e.g., a second value, of the return loss of the system is measured that corresponds to the new length of the adapter. In the present example, the second value is compared to the pre-determined threshold level to determine if the adjusted length of the adapter resulted in the change in the return loss of the system that was desired. If the length did not affect the return loss as desired, then the length is changed again, e.g., in accordance with steps 312-316. Further, the method 300 may continue until the value for the return loss that is measured for the system is the value for the return loss that is desired. Then, as discussed above, the method 300 optionally includes, at step 306, securing the length of the adapter, and at step 308, adjusting other ones of the adapter in the system so that the length of the adapters are substantially consistent across the adapters in the system.

While the present invention has been particularly shown and described with reference to certain exemplary embodiments, it will be understood by one skilled in the art that various changes in detail may be effected therein without departing from the spirit and scope of the invention as defined by claims that can be supported by the written description and drawings. Further, where exemplary embodiments are described with reference to a certain number of elements it will be understood that the exemplary embodiments can be practiced utilizing either less than or more than the certain number of elements.

What is claimed is:

1. An adapter for conducting an electrical signal having a wavelength (λ), the adapter comprising:

a center conductor having a longitudinal axis;

an adapter body in surrounding relation to the center conductor, the adapter body having an outer dimension and a length including a first length and a second length that is greater than the first length; and an insulative gap disposed between the center conductor and the adapter body, the insulative gap remaining substantially constant along the length, wherein the adapter body has a form factor defined as the ratio of the outer dimension to the length, the form factor includes a first form factor at the first length and a second form factor at the second length, the second form factor is less than the first form factor.

2. The adapter according to claim 1, further comprising a connective element disposed on opposite sides of the adapter body, the connective elements having an outer threaded surface adapted to receive a transmission line thereon.

3. The adapter according to claim 2, wherein the center conductor includes a plurality of conductive portions that each have a shape that is different from the shape of the other conductive portions.

4. The adapter according to claim 2, wherein the second length is consistent with about the wavelength (λ) of the electrical signal.

5. The adapter according to claim 1, wherein the adapter body has a first value of characteristic impedance at the first length and a second value of characteristic impedance at the second length that is substantially the same as the first value.

6. The adapter according to claim 5, wherein the insulative gap includes a dielectric material.

7. The adapter according to claim 1, wherein the form factor is defined in accordance with, $$f_f = \frac{D}{l},$$

where $f_f$ is the form factor, D is the outer dimension of the adapter body, and l is the length of the adapter body.

8. A phase adjustable adapter for use in a system having a nominal value of characteristic impedance, the phase adjustable adapter comprising:

a center conductor having a longitudinal axis;

a first elongated section in surrounding relation to the center conductor;

a second elongated section insertably engaging the first elongated section along the longitudinal axis, the second elongated section having a first position and a second position that is different than the first position; and an insulative gap disposed between the center conductor and the adapter body, the insulative gap remaining substantially constant when the second elongated section moves from the first position toward the second position, wherein the first elongated section and the second elongated section form an adapter body that has a form factor has a first form factor at the first position and a second form factor at the second position, the second form factor is less than the first form factor when the form factor is defined in accordance with, $$f_f = \frac{D}{l},$$

where $f_f$ is the form factor, D is an outer dimension of the adapter body, and l is a length of the adapter body.

9. The adapter according to claim 8, further comprising further comprising a connective element disposed on opposite sides of the adapter body, the connective elements having an outer threaded surface adapted to receive a transmission line thereon.

10. The adapter according to claim 8, further comprising a third elongated section in surrounding relation to at least one of the first and second sections.

11. The adapter according to claim 10, wherein the center conductor includes a plurality of conductive portions that each have a shape that is different from the shape of the other conductive portions.

12. The adapter according to claim 8, wherein the adapter body has a first value of characteristic impedance at the first length and a second value of characteristic impedance at the second length that is substantially the same as the first value.

13. The adapter according to claim 12, wherein the insulative gap includes a dielectric material.

14. The adapter according to claim 8, further comprising at least one retentive element in communication with the first elongated section and the second elongated section.

15. A method of varying an electrical length of an adapter for connecting a first component and a second component in a system having a nominal value of characteristic impedance, comprising:

providing a center conductor having a longitudinal axis;

providing an adapter body in surrounding relation to the center conductor, the adapter body including a first elongated section and a second elongated section insertably engaging the first elongated section, the second elongated section having a first position and a second position that is different than the first position; and forming an insulative gap between the center conductor and the adapter body, the insulative gap remaining substantially constant when the second elongated section moves from the first position toward the second position, wherein the first elongated section and the second elongated section form an adapter body that has a form factor with a first form factor at the first position of the second elongated section and a second form factor at the second position of the second elongated section, the second form factor is less than the first form factor when the form factor is defined in accordance with, $$f_f = \frac{D}{l},$$

where $f_f$ is the form factor, D is an outer dimension of the adapter body, and l is a length of the adapter body.

16. The method according to claim 15, wherein relative movement between the first elongated section and the second elongated section causes the first position of the second elongated section to change to the second position of the second elongated section.

17. The method according to claim 16, further comprising coupling the first elongated section and the second elongated section in a manner preventing rotation of at least the second elongated section when changing the first position of the second elongated section to the second position of the second elongated section.

18. The method according to claim 16, further comprising preventing relative movement between the first elongated section and the second elongated section with an external collar.

19. The method according to claim 15, further comprising disposing a dielectric material in the insulative gap.

20. The method according to claim 15, wherein the center conductor includes a plurality of conductive portions that each have a shape that is different from the shape of the other conductive portions.

* * * * *